United States Patent [19]

Tsuzurahara

[11] Patent Number: 4,720,658

[45] Date of Patent: Jan. 19, 1988

[54] MAGNETRON FILTER APPARATUS

[75] Inventor: Mamoru Tsuzurahara, Mobara, Japan

[73] Assignee: Hitachi, Ltd., Japan

[21] Appl. No.: 840,201

[22] Filed: Mar. 17, 1986

[30] Foreign Application Priority Data

Mar. 25, 1985 [JP] Japan ..... 60-58374
Jun. 12, 1985 [JP] Japan ..... 60-126003

[51] Int. Cl.[4] ..... H01J 25/50

[52] U.S. Cl. ..... 315/39.51; 315/39.53; 315/85

[58] Field of Search ..... 315/39.51, 39.53, 101, 315/85

[56] References Cited

U.S. PATENT DOCUMENTS 4,104,561 8/1979 Iwata ..... 315/101
4,131,824 12/1978 Nakai et al. ..... 315/39.51
4,156,829 5/1979 Harada ..... 315/39.51
4,163,175 7/1979 Tashiro ..... 315/39.51
4,164,685 8/1979 Takahashi ..... 315/39.51
4,223,245 9/1980 Ogura et al. ..... 315/39.51

*Primary Examiner*—Saxfield Chatmon
*Attorney, Agent, or Firm*—Antonelli, Terry & Wands

[57] ABSTRACT

A magnetron filter apparatus having a bottom box type filter case which is engaged and fixed with a cathode input side of a magnetron bulb and provided with a cover. A transformer which supplies a cathode current to the magnetron is contained in the filter case and a filter is contained in the filter case for preventing leakage of unwanted electromagnetic waves. Further, an insulation box in which the transformer is embedded and which is provided with integrally formed cylindrical portions through which lead wires to a primary winding of the transformer is disposed in the filter case. The insulation box is positioned by insertion of the cylindrical portions thereof into holes formed in a wall of the filter case.

6 Claims, 9 Drawing Figures

(a)

(b)

(a)

(b)

MAGNETRON FILTER APPARATUS

BACKGROUND OF THE INVENTION

1. Field of the Invention

The present invention relates to a magnetron filter apparatus and particularly to a structure of magnetron filter apparatus just suitable for a microwave range to be operated with a high frequency driving power supply.

2. Description of the Prior Art

FIG. 1 shows a basic concept of a power supply for driving a magnetron. In FIG. 1, numeral 1 denotes a commercial power supply of 50 or 60 Hz which generates a cathode current and a voltage to be supplied to the magnetron 3 with a transformer 2. 4 is a smoothing capacitor and 5 is a rectifying diode. The section enclosed by the dotted line 6 is a magnetron 3 designed with an ordinary structure. The section enclosed by the dotted line 7 is a filter apparatus integrally provided to the magnetron 3, which eliminates unwanted waves (mainly, TV noise) generated for the magnetron 3 with inductance of a choke coil 8 and a through capacitor 9.

Recently, development and investigation for practical use of a so-called inverter power supply which converts the frequency of a commercial power supply to the high frequency of 10k~100 kHz and thereby makes possible remarkable reduction of the size of a transformer required are showing dynamic advancement.

FIG. 2 shows a conventional magnetron filter apparatus. A bottomed box type filter case 16 is forced to engage with a cylindrical seal 10 of the magnetron bulb and a couple of leads 12 which support the cathode in the bulb are hermetically brazed together with terminals 13 through a stem ceramic 11 hermetically brazed to the cylindrical seal 10. The terminals 13 are respectively fixed with choke coils 8 wound around the ferrite core, with the other ends thereof connected to a through capacitor 9. This through capacitor 9 is fixed to a filter case 16 through a chassis plate 9*a* which is earthed. Moreover, a cover 17 is fixed to said filter case 16 by caulking the four sides thereof in order to shield unwanted waves such as harmonics of a magnetron. Above structure corresponds to the section enclosed by a dotted line 7 in FIG. 1. Usually a cathode current to be supplied to the terminals 12 of a cathode in the filter case 16 is comparatively as high as 10~16 A in the case of a magnetron and therefore a lead wire as thick as 1.0~1.6$\phi$ is necessary. Moreover in case of a commercial power supply it is disadvantage because a transformer itself becomes large in size due to its low frequency (50 or 60 Hz) to attempt to include said transformer which supplies the cathode current within the filter case 16.

SUMMARY OF THE INVENTION

It is an object of the present invention to provide a magnetron filter apparatus just suitable to be driven by an inverter power supply which converts the commercial power source to a high frequency power source.

Namely, by making the best use of remarkable reduction of the size of a transformer in case of an inverter power supply and thereby housing the whole or at least half of the transformer in a filter case of a magnetron the present invention provides a magnetron filter apparatus comprising a bottomed box type filter case which is engaged and fixed with a cathode input side of a magnetron bulb and is provided with a cover, a transformer which supplies a cathode current to a magnetron and is contained in said filter case, a filter contained in said filter case for preventing leakage of unwanted electromagnetic waves, and an insulation box in which said transformer is embedded and which is provided with integrally formed cylindrical portions through which lead wires to a primary winding of said transformer are inserted, said insulation box being positioned by insertion of said cylindrical portions into holes formed in a wall of said filter case; or a magnetron filter apparatus comprising a bottomed box type filter case which is engaged and fixed with a cathode input side of a magnetron bulb and is provided with a cover, a transformer which supplies a cathode current to a magnetron, and a filter contained in said filter case for preventing leakage of unwanted electromagnetic waves, said transformer having a first U-shaped core for a primary winding outside said filter case and a second U-shaped core for a secondary winding inside said filter case, and open ends of one or both of said first and second U-shaped cores being engaged with extruded portions formed in a wall of said filter case for positioning of said cores.

Further objects, features and advantages of the present invention will become apparent from the following description of preferred embodiments of the invention with reference to the accompanying drawings.

DESCRIPTION OF THE PREFERRED EMBODIMENTS

Figure 3:
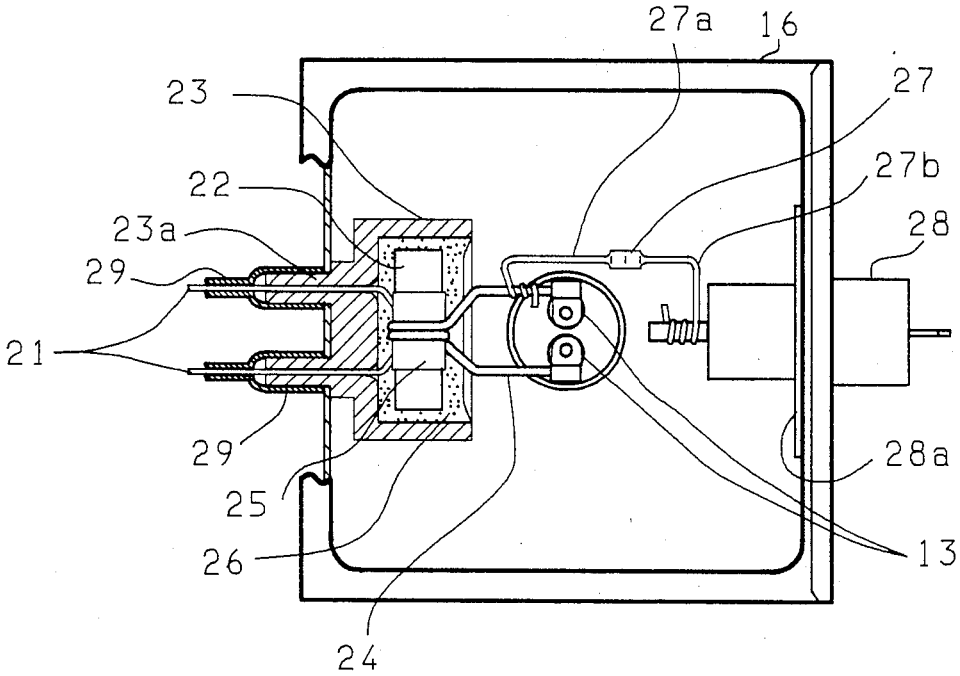
FIG. 3 is an embodiment where a transformer is housed within a magnetron filter case of the present invention.
Figure 3:
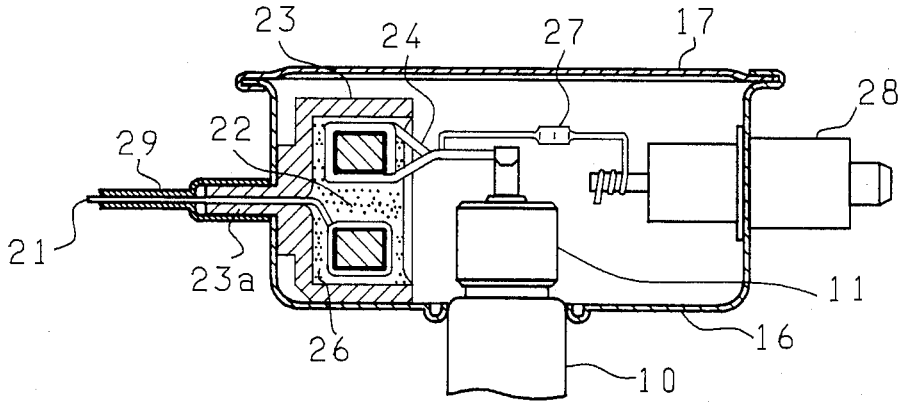

FIG. 3 is a structure of a filter apparatus including a transformer within a filter case of an embodiment of the present invention. In this figure, a part of bottom section of an insulation box 23 made of a box type plastic or ceramics including the core 22 of a transformer at the inside of filter case together with a guiding line 21 which is also used as the primary winding of a transformer which supplies a cathode current is extruded through the bottomed box type filter case 16 which is forced to be engaged with the seal 10 of a magnetron bulb. The insulation box 23 is fixed when the cylindrical section 23*a* formed integrally with said insulation box 23 is engaged into the through hole in the side wall of said filter case 16. The insulation box 23 is provided with a rectangular or circular (rectangular shape in FIG. 3) core 22 which functions as a magnetic core of a transformer and is wound by a secondary winding 24 and is connected to the terminals 13 to the cathode with the arc welding. Herein, a core 22 is made of a ferrite which shows less high frequency loss but it is inferior in insulation property to plastic, etc. Therefore, it is desirable to place said guide wires 21 and winding part of a secondary winding 24 with the insulation sheet 25 interposed between them and the core 22. Moreover, since the components in the insulation box 23 are housed almost without any gap around the core 22 and the secondary winding 24 is formed by comparatively thick wire, movement due to vibration can be suppressed considerably, and when these are fixed by molding with the epoxy resin 26 for improving insulation property, these are integrated to the insulation box 23 making easier the maneuvering.

Figure 1:
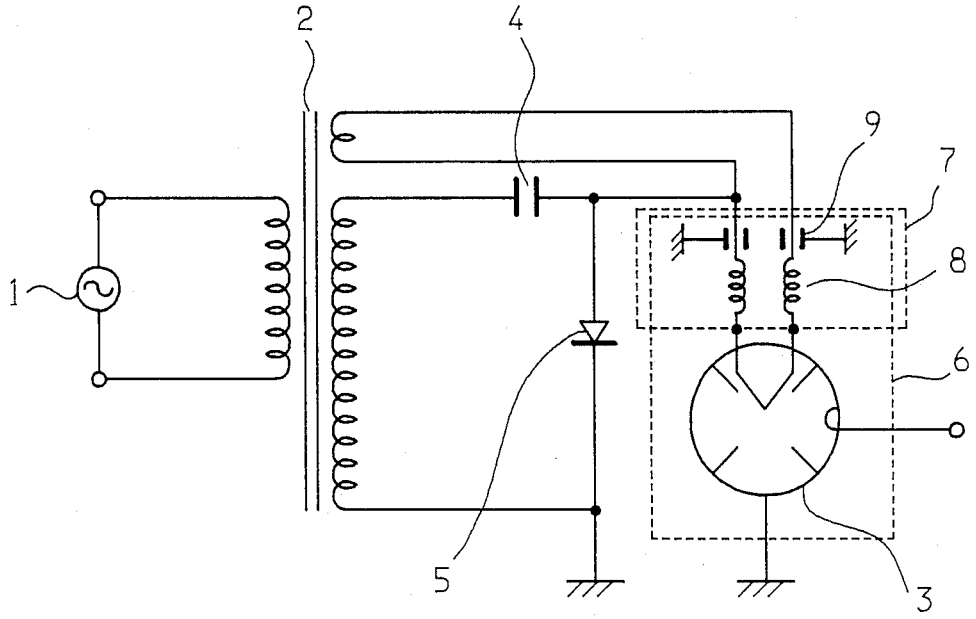
FIG. 1 shows a basic circuit structure of a driving power supply of a magnetron.
Figure 2:
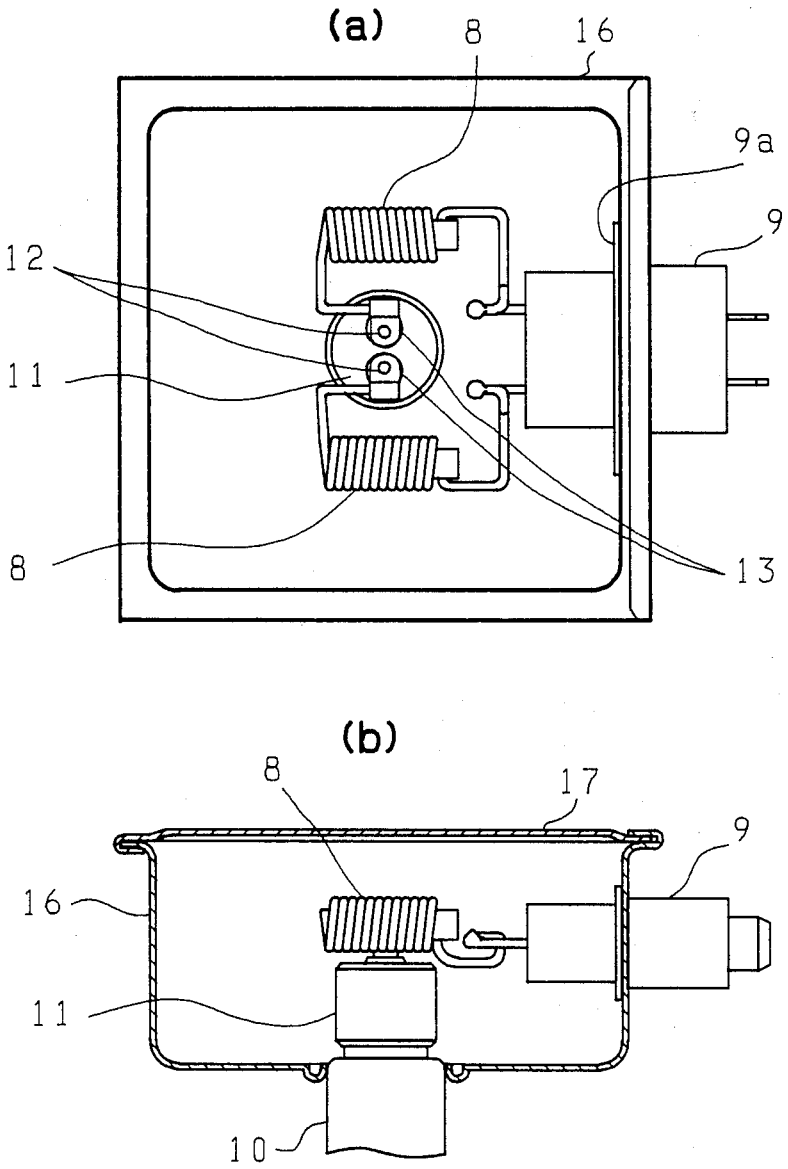
FIG. 2 is a conventional magnetron filter.

Meanwhile, a lead wire 27*a* of the inductance element 27 is connected to one end of said secondary winding and the other lead wire 27*b* to the through capacitor 28, in order to supply a high voltage. In this case, connection can be done by ordinary soldering work but since a current as low as 200~400 mA flows through the lead wires 27*a*, 27*b* of the inductance element 27, it is enough to use a fine lead wire as thin as 0.5$\phi$ or less. Accordingly, the wire can be wound using a lapping tool as shown in FIG. 3. Otherwise, said lead wires 27*a*, 27*b* may be made of iron, nickel or alloys of them, and the one may be fixed to said cathode while the other is fixed to the center conductor of said through capacitor 28 by the spot welding. In addition, in the case of a through capacitor 28, like the double-element through capacitor shown in FIG. 2, the chassis plate 28*a* set at the earth potential is fixed to said filter case 16. In the example of FIG. 3, the insulation box 23 and a through capacitor 28 are provided on the opposite walls of a filter case 16, but these may be fixed on the two perpendicular surfaces or on the same surface for convenience of external wirings.

Figure 4:
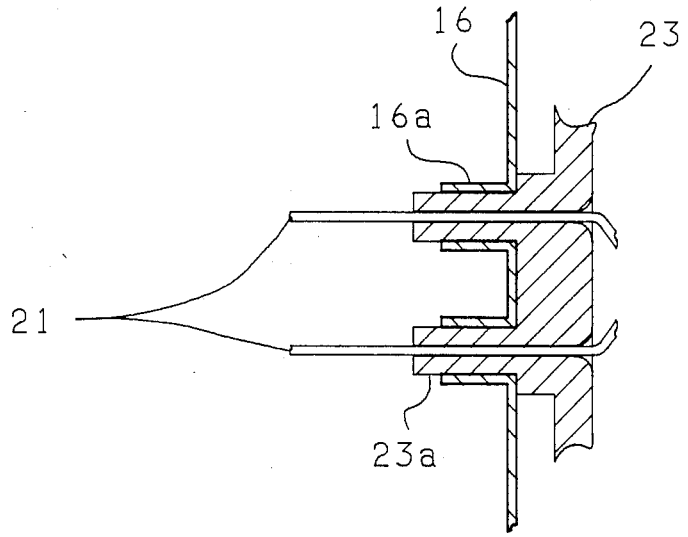
FIG. 4 and FIG. 5 show other embodiments of the section where an insulation box for accommodating a transformer is fixed.
Figure 5:
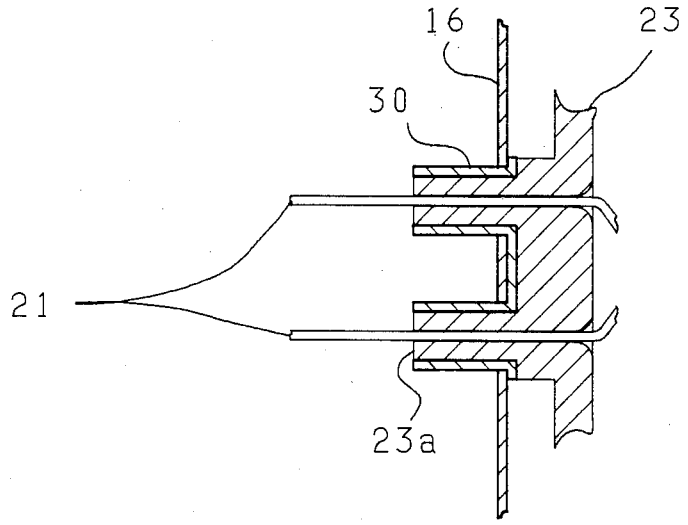

Regarding the fixing of insulation box 23, a cylindrical section 23*a* is inserted to a through hole provided to the filter case 16 as shown in FIG. 3 and the external circumference thereof is fixed with a heat compressive tube 29 together with the guide wire 21 or they can be fixed only with a bonding agent. Moreover, as shown in the partial diagram of FIG. 4, the function to prevent the waves from leaking can be improved by forming through holes with a cylindrical portion 16*a* through the burring hole in a wall of the filter case 16 and engaging thereto the cylindrical section 23*a* of the insulation box 23. Moreover, a metal bush 30 having a hat section formed separately as shown in FIG. 5 is engaged with said cylindrical section 23*a* and thereby the function to prevent the leak of waves can further be improved than in the example shown in FIG. 4.

Figure 6:
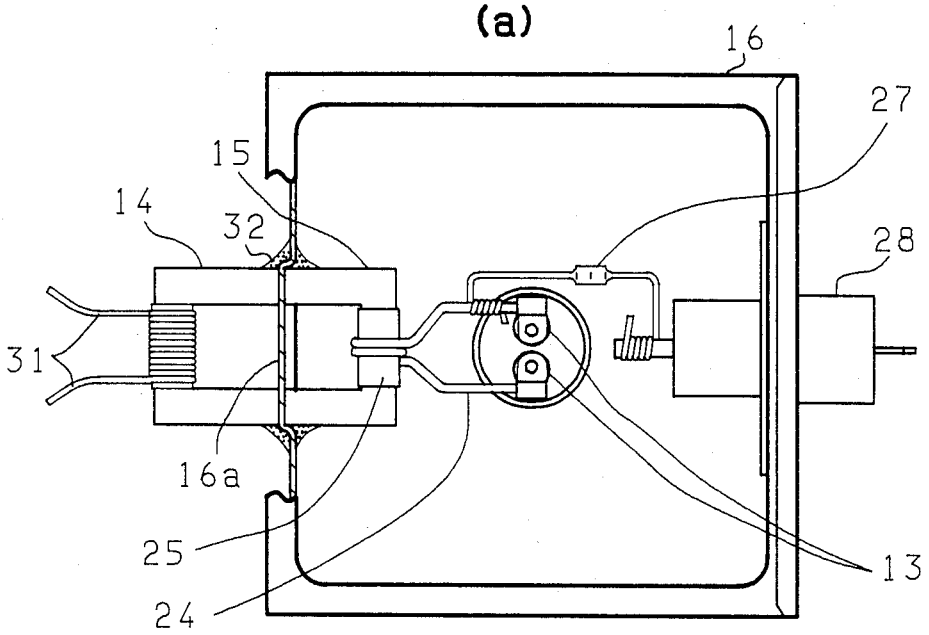
FIG. 6 shows an embodiment of the present invention where a closed magnetic loop is formed by placing in close contact the cores of a transformer from the internal and external sides of a side wall of a magnetron filter case.
Figure 6:
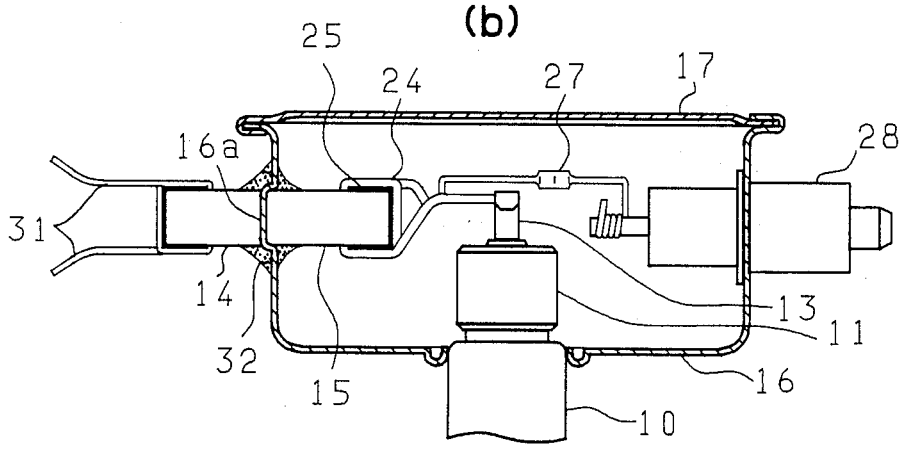

FIG. 6 shows another example of the present invention where a closed magnetic loop is formed by placing in close contact the cores of primary and secondary sides of a transformer from the internal and external surfaces of side wall of the filter case with a wall of the filter case interposed between them. In this figure, the U-shaped core 14 to which the primary winding 31 of the transformer which supplies the cathode current is wound (the ferrite having excellent high frequency characteristic is desirable material for the core) is located on an extruded section 16*a* provided to said filter case and ends of the U-shaped core 15, to which the secondary winding 24 of said transformer is wound are engaged with the extruded section 16*a*. These cores are fixed by the bonding agent 32, and a closed magnetic loop is formed together with said cores 14 and 15 with said extruded section 16*a* interposed between them. Said extruded section 16*a* is extruded toward the outside of said filter case 16 in the example of FIG. 6, but since the main object of it is positioning of the cores 14, 15, it may be extruded toward the inside.

Figure 7:
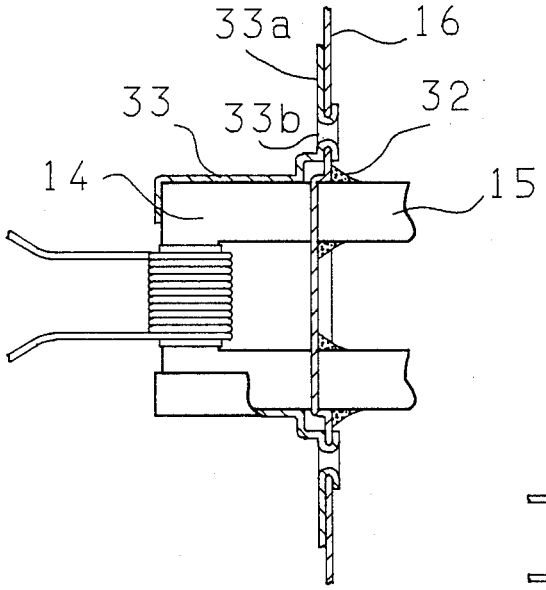
FIG. 7, FIG. 8 and FIG. 9 show the principal section of further embodiments of the transformer coupling section.

In the example of FIG. 7, the core 14 of the primary side of a transformer is covered with a holder 33 except for the winding section and the flat plate 33*a* of said holder is fixed by caulking to the side surface of said filter case 16 through the burred holes 33*b*. Thereby, it is no longer necessary to fix the core 14 with the bonding agent and positioning can also be done easily. The flat section 33*a* of a holder 33 can also be fixed by rivetting or screwing in place of the caulking.

Figure 8:
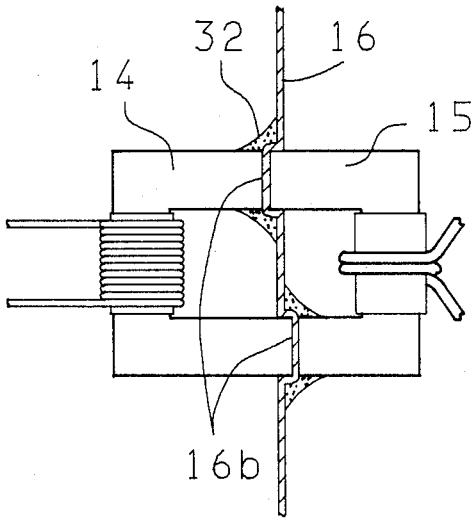

In the example of FIG. 8, a pair of extruded sections 16*b* extruded to the internal and external sides are provided to the side surface of said filter case 16, one end of respective cores 14, 15 is engaged with corresponding extruded sections 16*b* in order to make easier the positioning. Therein, a rectangular, ellipse and triangular cross-section of a core other than the circular section is very convenient for preventing displacement in the rotating direction.

Figure 9:
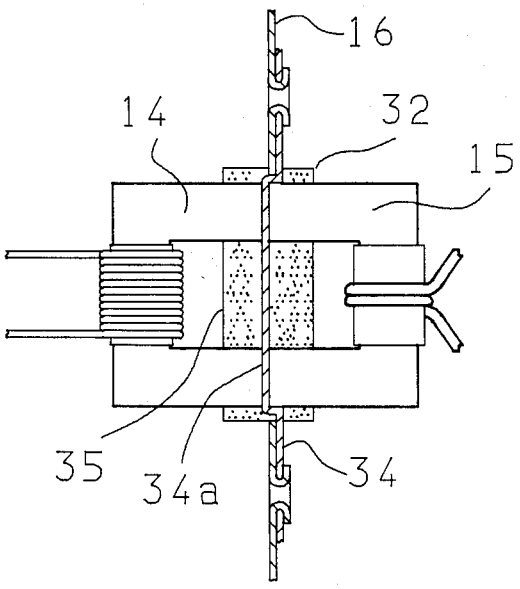

In the example of FIG. 9, in order to form a transformer, an extruded section 34*a* is formed of the metal plate 34 separated from said filter case 16. The cores 14, 15 are molded together with a metal plate 34 interposed between them with resin 35 and the metal plate 34 fixed by caulking to said filter case 16. In the figure, a window through which the core 15 of the secondary side of a transformer is to be inserted is provided and holes for caulking are burred in the side wall of the filter case 16 and said metal plate 34 is fixed by caulking to the filter case 16. In this case, it can also be fixed by rivetting, screwing or welding instead of caulking.

In above examples of structure, the transformer forms a closed magnetic loop via the wall of the filter case 16. Therefore, a loss of magnetic flux is inevitable but thickness of the wall of the filter case 16 is as thin as 0.5 mm or less and the magnetic flux can be sufficiently compensated for by increasing the number of turns of winding. Generally, as the material of the filter case 16, an economical zinc plated steel plate is used and loss of magnetic flux can be alleviated using non-magnetic metal such as aluminum.

In a magnetron filter apparatus of the present invention which is driven by a high frequency power source, a transformer which supplies a cathode current is accommodated within the filter case with good insulation characteristic or a transformer is directly and integrally provided to the filter case and moreover the magnetic core of a transformer is coupled through a metal body. Therefore, leak of electromagnetic waves from the power supply can be prevented perfectly and thereby a highly reliable magnetron filter apparatus ensuring easy assembling can be obtained.

What is claimed is:

1. A magnetron filter apparatus comprising:

a box type filter case having a bottom and side walls with an open top, the bottom of the box type filter case engaging and being fixed to a cathode input side of a magnetron bulb, and a cover for closing the top of the box type filter case, at least one side wall of the box type filter case having openings therein;

a transformer for supplying a cathode current to the magnetron being disposed within the box type filter case, the transformer including a primary winding;

a filter for preventing leakage of unwanted electromagnetic waves being disposed in the box type filter case; and an insulation box disposed within the box type filter case, the insulation box having the transformer embedded therein and including integral cylindrical portions for receiving lead wires connected to the primary winding of the transformer, the cylindrical portions of the insulation box being received in corresponding openings in the at least one side wall of the box type filter case for positioning the insulation box within the box type filter case for enabling accuracy in assembly and improvement in reliability of electrical insulation, resistance to vibration and prevention of leakage of electromagnetic waves.

2. A magnetron filter apparatus according to claim 1, wherein the insulation box comprises one of plastic and ceramic material.

3. A magnetron filter apparatus according to claim 2, further comprising a resin for embedding the transformer in the insulation box.

4. A magnetron filter apparatus comprising:

a box type filter case having a bottom and side walls with an open top, the bottom of the box type filter case engaging and being fixed to a cathode input side of a magnetron bulb, and a cover for closing the top of the box type filter case, at least one side wall of the box type filter case having an extruded portion thereof;

a filter for preventing leakage of unwanted electromagnetic waves being disposed in the box type filter case; and a transformer for supplying a cathode current to the magnetron, the transformer including a first U-shaped core for a primary winding disposed outside of the box type filter case and a second U-shaped core for a secondary winding disposed inside of the box type filter case, open ends of at least one of the first and second U-shaped cores being engaged with the extruded portion in the at least one side wall of the box type filter case for positioning the U-shaped cores for enabling accuracy in assembly and improvement in reliability of electrical insulation, resistance to vibration and prevention of leakage of electromagnetic waves.

5. A magnetron filter apparatus according to claim 4, further comprising a bonding agent for fixing the first and second U-shaped cores with the extruded portion in the at least one side wall of the box type filter case.

6. A magnetron filter apparatus according to claim 4, wherein the at least one side wall having the extruded portion is a substantially planar surface member and the extruded portion therein extends from the planar surface member in at least one of a direction toward the interior of the box type filter case and outwardly therefrom.

* * * * *